US006148283A

United States Patent [19]

Das

[11] Patent Number: 6,148,283

[45] **Date of Patent: *Nov. 14, 2000**

[54] METHOD AND APPARATUS USING MULTI-PATH MULTI-STAGE VECTOR QUANTIZER

[75] Inventor: Amitav Das, San Diego, Calif.

[73] Assignee: Qualcomm Inc., San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/159,246

[22] Filed: Sep. 23, 1998

[51] Int. Cl.[7] ..... G10L 19/00

[52] U.S. Cl. ..... 704/222; 704/230

[58] Field of Search ..... 704/219, 222, 704/262, 230, 266, 221, 223; 382/251, 252, 253

[56] References Cited

U.S. PATENT DOCUMENTS

| | | | |
|---|---|---|---|
| 5,243,686 | 9/1993 | Tokuda et al. | 704/200 |
| 5,398,069 | 3/1995 | Huang et al. | 348/422 |
| 5,408,234 | 4/1995 | Chu | 341/106 |
| 5,535,305 | 7/1996 | Acero et al. | 704/256 |
| 5,651,026 | 7/1997 | Lin et al. | 704/222 |
| 5,737,484 | 4/1998 | Ozawa | 704/222 |
| 5,774,839 | 6/1998 | Shlomot | 704/222 |
| 5,787,390 | 7/1998 | Quinquis et al. | 704/219 |
| 5,822,723 | 10/1998 | Kim et al. | 704/222 |
| 5,859,932 | 1/1999 | Etoh | 382/253 |
| 5,890,110 | 3/1999 | Gersho et al. | 704/222 |
| 5,966,688 | 10/1999 | Nandkumar et al. | 704/222 |

OTHER PUBLICATIONS

Law et al., "Split–Dimension Vector Quantization of Parcor Coefficients for Low Bit Rate Speech Coding," IEEE Transactions on Speech and Audio Processing, vol. 2, No. 3, pp. 443 to 446, Jul. 1994.

Pan et al., "Vector Quantization–Lattice Vector Quantization of Speech LPC Coefficients," IEEE International Conference on Acoustics, Speech and Signal Processing, pp. I/513 to I/516, Apr. 1994.

*Primary Examiner*—David R. Hudspeth
*Assistant Examiner*—Martin Lerner
*Attorney, Agent, or Firm*—Philip Wadsworth; Thomas R. Rouse; Bruce W. Greenhaus

[57] ABSTRACT

A multi-path, split, multi-stage vector quantizer (MPSMS-VQ) having multiple paths between stages which result in a robust and flexible quanitizer. By varying parameters, the MPSMS-VQ meets design requirements, such as: (1) the number of bits used to represent the input vector (i.e., uses the same or less total bits than the given number of bits, N); (2) the dimension of the input vector, the performance (distortion as noted by WMSE or SD); (3) complexity (i.e., total complexity can be adjusted to be within a complexity constraint); and (4) memory usage (i.e., total number of words M in the codebook memory can be adjusted to be equal to, or less than, the memory constraint $M_d$). Therefore, the disclosed method and apparatus works well in many conditions (i.e., offers a very robust performance across a wide range of inputs).

5 Claims, 9 Drawing Sheets

FIGURE - S2 - MPSMS-VQ ARCHITECTURE
NO. OF PATHS = Q
NO. OF STAGES = S

METHOD AND APPARATUS USING MULTI-PATH MULTI-STAGE VECTOR QUANTIZER

BACKGROUND OF THE INVENTION

1. Field of Invention

This invention relates to telecommunications systems. Specifically, the present invention relates to systems and techniques for digitally encoding and decoding speech.

2. Description of the Related Art

Wireless telecommunications systems are used in a variety of demanding applications ranging from search and rescue operations to business communications. These applications require efficient transmission of voice with minimal transmission errors and downtime. Recently, transmission of voice by digital techniques has become widespread, especially in long distance and digital radio telephone applications. This, in turn, has created interest in reducing the amount of information that need be sent over a channel while maintaining the perceived quality of the received speech. If speech is encoded for transmission by simply sampling and digitizing the analog voice signals to be transmitted, a data rate on the order of 64 kilobits per second (kbps) is required to achieve a speech quality which is comparable to that attained by a conventional analog telephone. However, through the use of digital speech compression techniques, a significant reduction in the data rate can be achieved.

Devices that compress a digitized speech signal by extracting parameters that relate to a model of human speech generation are commonly referred to as "vocoders". Vocoders include an encoder, and a decoder and operate in accordance with a specified scheme for transmitting the information from the encoder to the decoder in the form of digital bit packets.

The task of the encoder is to analyze a segment of input speech, commonly referred to as a "frame". A frame typically contains 20 ms of speech signal. Accordingly, for a typical 8000 Hz sampled telephone speech, a frame contains 160 samples. A set of bits, commonly referred to as a "digital packet" is then generated which represents the current frame. The encoder applies a certain speech model to the input frame and, by analyzing the input frame, extracts model parameters. The encoder then quantizes the model parameters, such that each parameter is represented by its "closest representatives" selected from a set of representatives. This set of representatives is commonly referred to as a "codebook". A unique "index" associated with each representative within the codebook identifies each representative. After quantization, there will be an index which represents each parameter. The digital packet is composed of the set of indexes which represent all of the parameters in the frame. The indexes are represented as binary values composed of digital bits.

The decoder first "unquantizes" the indexes. Unquantizing includes creating the model parameters from the indexes in the packet and then applying a corresponding synthesis technique to the parameters to re-create a close approximation of the input frame or segment of speech. The synthesis technique can be thought of as the reverse of the analysis technique employed by the encoder. The quality of the compressed speech at the output of the decoder is measured by objective measures, such as Signal to Noise Ratio (SNR) (see equation 1 below) or by subjective quality comparison tests, such as Mean Opinion Score (MOS) tests, involving human subjects.

$$S: [S_i \;\; S_2 \;\; \ldots \;\; S_N] \quad \text{input speech frame} \tag{1}$$

$$\hat{S}: [\hat{S}_1 \;\; \hat{S}_2 \;\; \ldots \;\; \hat{S}_N] \quad \text{compressed speech frame}$$

$$SNR = 10 \log_{10}\left(\frac{\sum_{i=1}^{N} S_i^2}{\sum_{i=1}^{N} (Si - \hat{S}i)^2}\right) \text{dB} \tag{1}$$

The size of the packet (M bits, in one example) is far smaller than the size of the original frame (N bits, in the same example). A "compression ratio" is defined as $R_c$=M/N. The goal of the vocoder is to obtain the best speech quality possible given a specified compression ratio or using a given value of M. The quality of the compressed speech (i.e., the quality of the vocoder) depends on the speech model employed (i.e., the analysis-synthesis technique) as well as on the parameter quantization scheme.

Once a suitable speech model is chosen, the best possible quantization schemes for the chosen speech model parameters must be determined. This includes designing the actual quantization schemes as well as a judicious assignment of the available M bits to represent the various speech model parameters of the frame. For a vocoder, an effective quantization of the model parameters is the most crucial factor in delivering overall good speech quality.

Adaptive predictive coding (APC) (as described in B. S. Atal "Predictive Coding of speech at low bit rates", IEEE Trans. Communication, vol, IT-30, pp, 600–614, April 1982) is the most widely used and popular speech compression scheme used in telecommunication and other speech communication systems all over the world. A particularly popular APC algorithm is Code Excited Linear Prediction or CELP, such as the one described in U.S. Pat. No. 5,414,796, issued May 9, 1995 to Jacobs et al., which is incorporated herein by reference. Such algorithms are performed by devices commonly referred to as "APC coders". Various APC coders have been adapted as international standards, such as ITU-G.728, G.723, and G.729.

In APC coders, two adaptive predictors, a short-term ("formant") predictor and a long-term ("pitch") predictor, are used to remove redundancy in speech. Corresponding to an $L^{th}$ order short-term predictor in the analysis stage of the encoder, is an all-pole synthesis filter used in the decoder, having a transfer function expressed in z-transform notation of H(z)=1/A(z), where:

$$A(z) = 1 - \sum_{l=1}^{L} A_l z^{-l} \tag{2}$$

The parameters $\{a_1\}$, 1=1, 2, . . . L, are known as linear predictive coefficients (LPCs). For each frame, a set of LPCs are generated by an APC encoder. Normally, the LPCs are not directly quantized, but instead are first transformed into equivalent representation formats, such as Reflection Coefficients (RCs), or Line Spectral Pairs (LSPs). These equivalent transformation formats are more amenable to the quantization process than the LPCs themselves. LSPs are the most popular representation of LPCs. LPCs are computed in accordance with conventional methods, such as the method disclosed in (a) Rabiner and Schafer, "Digital Processing of Speech Signals", Prentice Hall Publisher, 1978), (b) Soong and Juang, "Line Spectrum Pair (LSP) and speech data compression", Proceedings of Intl. Conf. On Accoust. Speech and Signal Processing (ICASSP), May 1984, pp 1.10.1 to 1.10.4, and (c) Kabal and Ramachandran, "The computation of line spectral frequencies using Chebyshev polynomials", in IEEE Trans. Acoust. Speech and Signal Processing, vol. ASSP-34, pp 1419–1426, December. 1986.

LSPs comprise a set of L numbers that can be characterized as an LSP vector of dimension (i.e., length) L. The overall quality of the vocoder significantly depends on how well these LSP vectors are quantized. Since the vocoder has only M bits available to represent the LSPs of a frame, it is crucial to perform the LSP quantization with as few bits as possible in order to allow more bits to be allocated to quantize other parameters of the vocoder.

The following describes some of the conventional methods that have previously been used to quantize LSPs and the manner in which performance of an LSP quantization process is measured.

For an L-dimension LSP vector, X, Y is the LSP vector after quantization by some quantization scheme. The LSPs of the LSP vector, X, are referred to here as $\{a_1\}$ and $\{b_1\}$, where 1=1, 2, . . . L. The corresponding all-pole polynomials are A(z) and B(z). Furthermore, W is a suitable weight vector whose components, ($W_I$, for example), represent the sensitivity of the corresponding LSP parameter ($X_i$). One such weighting mechanism is:

$$Wi = \frac{1}{Xi - X_{i-1}} + \frac{1}{X_{i+1} - Xi} \tag{3}$$

$$i = 1, 2, \ldots L \quad X_0 = 0 \text{ and } X_{L+1} = \pi \tag{3}$$

The most widely used objective distortion measures of the performance of the LSP quantization scheme are: (a) Spectral Distortion (SD); and (b) Weighted Mean Square Error (WMSE) defined as:

$$SD = \left\{ \frac{1}{N_f} \sum_{i=1}^{N_f} \left( \frac{100}{\pi \int_o^{\pi} ([\log_{10}|ai(e^{jw})|^2 - \log_{10}|bi(e^{jw})|^2])^2 \, dw} \right) \right\}^{1/2} \tag{4}$$

$A_i$: all pole polynomial of ith frame with original LSP $B_i$: all pole polynomial of ith frame with quantized LSP $N_f$: that no. of frames under measurement $$WMSE = \sum_{l=1}^{L} W_l (X_l - Y_l)^2 \tag{5}$$

Each of these distortion equations provides a measure of the amount of distortion that occurs in the LSP quantization with respect to the original unquantized input set of LSPs.

The performance of the LSP quantization can also be measured by listening to two versions of decoded speech, S1 and S2, the first being the unquantized set of LSPs {X} and the second being the quantized set of LSPs {Y}. The listener then identifies whether the LSP quantization is "transparent" or not, (i.e. whether S1 and S2 are perceptually identical or not).

It has been shown that if the average value of SD is under 1 dB and if the percent of outliers (cases when SD is greater than 2 dB) is less than 1%, then the LSP quantization will be transparent to an average listener.

As noted above, an LSP quantization scheme of a vocoder under test uses a certain number of bits, N and it needs to deliver a certain quality (i.e., have a spectral distortion level that is below a specified value of SD). The vocoder will be implemented on some computing platform, such as a digital signal processor with limited computation power and a limited number of words of memory. Therefore, it is necessary to minimize the computational complexity and memory requirements of the LSP quantization process (or at least keep them within a given set of constraints).

Thus, the objective of an LSP quantization process is to produce the smallest SD possible for a given number of bits N, while keeping the computational complexity and memory requirements of the quantization scheme (i.e., amount of memory required to store the codebooks) within the constraints of the design specification of the system.

Another important issue is how well the LSP quantizer performs with different speakers, spoken languages, and environmental conditions (i.e., noisy or noiseless conditions). This is commonly referred to as the "robustness" of the system across various input statistics. Typically, a vector quantizer, such as a LSP quantizer, is designed by training a codebook with a training set. The training set contains a large number of input vectors. The input vectors attempt to represent the type of input that will be encountered during the operation of the quantizer, taking into account the overall input statistical distribution. In practical applications, such as in telecommunications, a wide variety of people all over the world, speaking many different languages, will be using the vocoder system. Thus, the LSP quantizer needs to be robust.

The following conventional LSP quantizing schemes are known. A vector, such as the L-dimensional LSP vector X={$X_i$}, i=1, 2, . . . , L, can be quantized in two different ways: a) by scalar quantization (SQ) and b) by direct vector quantization (VQ). In SQ, each component, $X_i$, is individually quantized, whereas in VQ, the entire vector X is quantized as an individual entity (a vector). SQ is computationally simpler than VQ, but requires a very large number of bits to deliver an acceptable performance. VQ is more complex, but is a far better solution when the bit-budget (i.e., the number of bits that are available to represent the quantized values) is low. For example, for a typical LSP quantization problem where L=10 and the number of bits allocated is N=30, if SQ is employed, then each Xi will have only 3 bits or only 8 representatives leading to a very poor performance. A 30-bit VQ will provide a far superior performance, since there are, in theory, 2 raised to the $30^{th}$ power (i.e., 1 billion) vectors to select from to represent the entire vector.

For example, an L-dimensional vector is directly quantized with a codebook having M representatives or "codevectors" {$C_k$}, k=1, 2, . . . M. For a particular input vector X and a weight vector W, the objective is to find the codevector $C_{k^*}$, which results in the minimum VQ distortion, $D_{k^*}$, with respect to the input vector X (i.e., the least detectable difference). The index k* is associated with a particular value $C_{k^*}$ from among the codevectors $C_k$ and the associated minimum VQ distortion, $D_{k^*}$ with respect to the input vector X. The codevector $C_{k^*}$ is transmitted to the decoder. The parameters used to evaluate the quality of a VQ scheme are: (a) distortion, D (typically measured and averaged over a large number of test inputs), (b) number of bits, N, used to represent the entire input vector, (c) codebook memory size, $M_{CB}$ and (d) the computational complexity (dominated by the process of searching for the best codevector at the encoder).

For a direct VQ scheme, in which N=30 bits, and L=10, the codebook will need to store $2^{30}$ codevectors (i.e., $2^{30}\times10$ words/codevector of memory) and the search complexity (number of multiply-add operations) will be proportional to a very large number $2^{30}\times10=10,737,418,240$.

The above number is beyond the resources of any practical system. In other words, direct VQ is not feasible for practical implementations of LSP quantization. Accordingly, variations of two other VQ techniques, Split-VQ (SPVQ) and Multi Stage VQ (MSVQ), are widely used.

In SPVQ, the input vector X (an LSP vector, for example) is split into a number of splits or "sub-vectors" $X_j$, j=1, 2, . . . , $N_s$, where $N_s$ is the number of sub-vectors, and each sub-vector $X_j$ is quantized separately using direct VQ. Thus, SPVQ reduces the complexity and memory requirements by splitting the VQ into a set of smaller size VQs. In one example of a Split VQ is used to quantize a vector of length L=10 using N=30 bits. The input vector X is split into 3 sub-vectors $X_1=(x_1\ x_2\ x_3)$, $X_1=(X_4\ X_5\ X_6)$, and $X_1=(X_7\ X_8\ X_9\ X_{10})$. Each sub-vector is quantized by one of three direct VQs, each direct VQ using 10 bits, and thus allowing each codebook to have 1024 codevectors. In this example, the memory usage is proportional to $2^{10}$ codevectors times 10 words/codevector=10240 words (far less than the 10,737,418,240 words needed for the direct 30-bit VQ). In addition, the search complexity is equally reduced. Naturally, the performance of such an SPVQ will be inferior to the direct VQ, since there are only 1024 choices (i.e., representatives to choose from) for each input vector, instead of 1,073,741,824 choices that are available in the direct VQ. In an SPVQ quantizer, the power to search in a high dimensional (L) space is lost by partitioning the L-dimensional space into smaller sub-spaces. Therefore, the ability to fully exploit the entire intra-component correlation in the L-dimensional input vector is lost.

MSVQ offers less complexity and memory usage than the SPVQ scheme by doing the quantization in several stages. Each stage employs a relatively small codebook. The input vector is not split (unlike SPVQ), but rather is kept to the original length L. In one example, an MSVQ is used for quantizing an LSP vector of length 10 with 30 bits and using 6 stages. Each stage has 5 bits, resulting in a codebook that has 32 codevectors. $X_i$ is the input vector of the $i^{th}$ stage and $Y_i$ is the quantized output of the $i^{th}$ stage (i.e. the best codevector obtained from the $i^{th}$ stage VQ codebook CBi). The input to the next stage is a "difference vector", $X_{i+1}=X_i-Y_i$ The use of multiple stages allows the input vector to be approximated stage by stage. At each stage the input dynamic range becomes smaller and smaller. The computational complexity and memory usage is proportional to $6\times32\times10=1920$. It is clear that this is even smaller than the number complexity and memory usage associated with the SPVQ. The multi-stage structure of MSVQ also makes it very robust across a wide variance of input vector statistics. However, the performance of MSVQ is sub-optimal, mainly because the codevector search space is very limited now (only 32) and due to the "greedy" nature of MSVQ, as explained below.

MSVQ finds the "best" approximation of the input vector X in the input stage, creates a difference vector $X_1$, and then finds the "best" A representative for difference vector in the second stage. The process repeats. This is a greedy approach, since selecting a candidate other than the best candidate in the input stage may have resulted in a better final result. The inflexibility of selecting only the best candidate in each stage hurts the overall performance.

While direct VQ offers the best performance, it is often impracticable to implement a direct VQ due to the relatively high memory usage and complexity. SPVQ and MSVQ have the following advantages, respectively. SPVQ has a relatively high codebook resolution and is simpler to implement than direct VQ. MSVQ has a very low complexity. However, each has some severe limitations as well. For example, SPVQ does not exploit the full intra-component correlation (the VQ advantage) as it splits the input dimension. MSVQ has a low search space.

Therefore, there is a need for a process for quantizing the input LSP vector that has a flexible architecture that can be matched to a desired distortion, memory usage, and complexity.

SUMMARY OF THE INVENTION

Disclosed in this document is a method and apparatus that includes the present invention as defined by the claims appended this document. The disclosed method and apparatus includes a vector quantizer (VQ) (such as an LSP quantizer) using an architecture that is flexible and which meets design restrictions over a wide range of applications due to a multi-path, split, multi-stage vector quantizer (MPSMS-VQ). The disclosed method and apparatus also delivers the best possible performance in terms of distortion (i.e., reduces distortion to the lowest practically achievable level) by capturing the advantages of split-vector quantizer (SPVQ) and multi-stage vector quantizer (MSVQ) and improving on both of these techniques. The improvement is the result of adding multiple paths between stages and which result in a very robust and flexible quantizer while overcoming the disadvantages of the SPVQ and MSVQ techniques. By varying parameters of this flexible architecture, the disclosed method and apparatus can provide a design which meets the design requirements, such as: (1) the number of bits used to represent the input vector (i.e., uses the same or less total bits than the given number of bits, N); (2) the dimension of the input vector, the performance (distortion as noted by WMSE or SD); (3) complexity (i.e., total complexity can be adjusted to be within a complexity constraint); and (4) memory usage (i.e., total number of words M in the codebook memory can be adjusted to be equal to, or less than, the memory constraint $M_d$). Therefore, the disclosed method and apparatus works well in many conditions (i.e., offers a very robust performance across a wide range of inputs).

Although the method and apparatus is primarily disclosed in the context of the quantization of LSPs in a speech encoder, the claimed invention is applicable to any application in which information represented by a set of real numbers (e.g., a vector) is to be quantized.

In one example of the method and apparatus disclosed, an MPSMS-VQ quantizes an input vector $\underline{X^1}$ of dimension $L^1$ using S stages, where $\underline{X^i}$ is the input to the $i^{th}$ stage and $L^i$ is the dimension of the vector $\underline{X^i}$(i.e., length of the vector measured by the number of discrete values, such as LSP values, which comprise the vector). Each stage $S^i$ uses a codebook having a predetermined number "M" of codevectors $C^i_k$, where k=1, 2, . . . M. For all of the codevectors, the total memory required is equal to $m^i$ words of memory. The number of codevectors $C^i_k$ is preferably equal to 2 raised to the power $n_i$, where $n_i$ is the number of bits that are used to represent each input vector and i indicates the stage to which the input vector is input. Since each codevector $c^i_k$ is of length $L^i$, the total number $m^i$ of words in the codebook associated with the $i^{th}$ stage (i.e., the "$i^{th}$ stage codebook") is equal to $L^i\times$(2 raised to the power $n_i$). The input vector $\underline{X^1}$ is coupled to the input stage. Each codevector $C^i_k$ in the input stage codebook is compared with the input vector $\underline{X^1}$.

The difference between each codevector and the input vector $\underline{X}^1$ forms an error vector $\underline{E}^1$ which represents the distortion that exists at the output of the input stage with respect to the input vector $\underline{X}^1$. A predetermined number "Q" of the best codevectors are selected from the input stage codebook. The best codevectors are defined as those codevectors that result in the least distortion with respect to the input vector $\underline{X}^1$. A corresponding set of indexes, $R_1, R_2, \ldots R_j$ represent the Q best codevectors $C^i_j$. These indexes form an index vector $\underline{R}$. These Q best codevectors $C^i_j$ are then each subtracted from the input vector $\underline{X}$. The difference between each codevector $C^i_j$ and the input vector forms Q new input vectors that are each input to the next stage. Each of these "new" input vectors is then compared to each of the codevectors $c^i_j$ in the next stage codebook to determine the Q best codevectors $C^i_j$ to be used to generate the output from this next stage. An error vector $\underline{E}^2$ is generated that comprises components $E^2_j$, each of which indicates the overall distortion associated with a corresponding one of the codevectors $C^i_j$, similar to the error vector $\underline{E}^1$. The Q best codevectors associated with the Q inputs are subtracted from the input to the $i^{th}$ stage to generate an output vector $\underline{Y}^i$ to the $(i+1)^{th}$ stage. This process is repeated for each additional stage. A path to the best codevector output from the last stage is then traced to determine the elements of a new vector $\underline{X}$^. $\underline{X}$^ has as its elements the codevector, $\underline{C}^i$, selected from each stage $S^i$ along the path to the codevector associated with the lowest overall distortion output from the last stage. The vector $\underline{X}$^ is uniquely represented by an index vector $\underline{R}$ comprised of a set of integers $\{R^1, R^2, \ldots, R^s\}$, represented in digital form by N bits. Each integer of the index vector is a unique index $R^i$ that is associated with a particular codevector within the vector $\underline{X}$^ and which can be determined by reference to the $i^{th}$ stage codebook. For example, $R^1$ is the index into the input stage codebook and is associated with the first element of the vector $\underline{X}$^, $R^2$ is the index into second stage codebook and is associated with the second element of the vector $\underline{X}$^. A corresponding weighting vector, W, may also be supplied to the quantizer.

BRIEF DESCRIPTION OF THE DRAWINGS

Like reference numbers refer in each of the figures to like elements.

DETAILED DESCRIPTION OF THE INVENTION

Figure 1A:
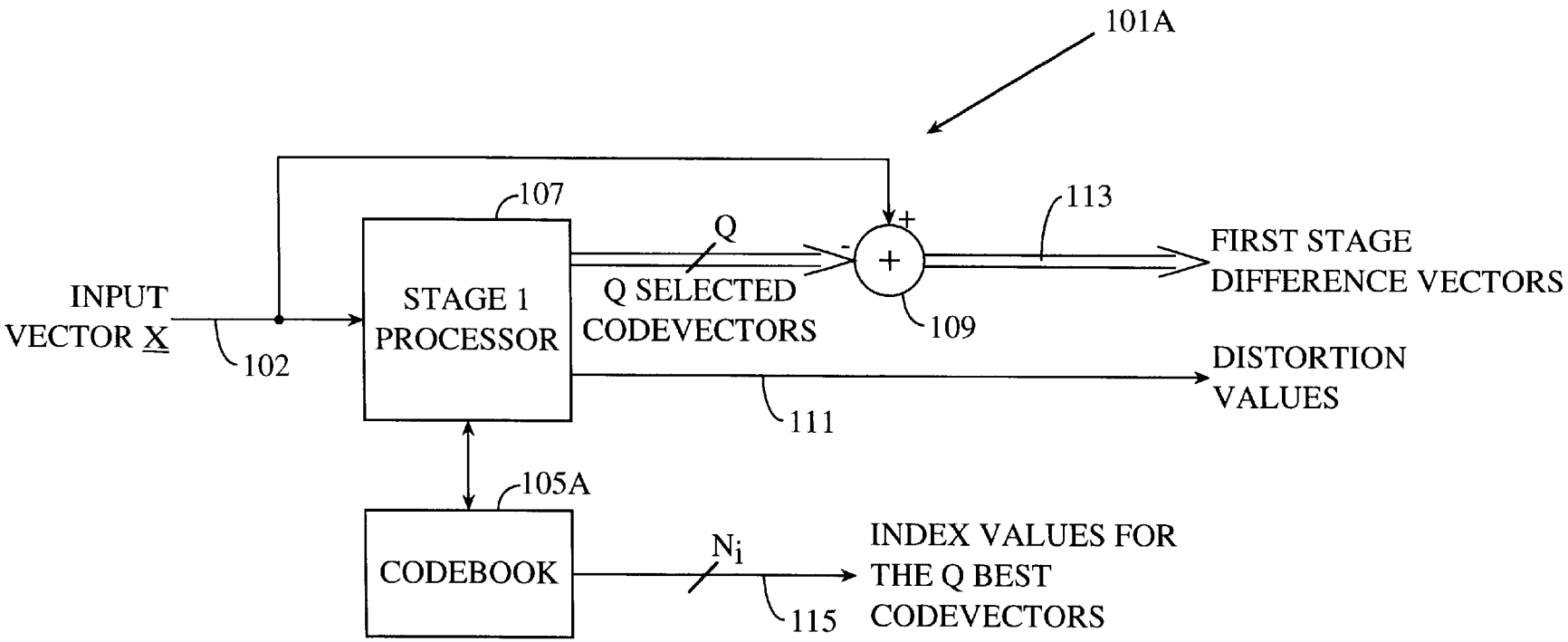
FIG. 1*a* illustrates the input stage of the MPSMS-VQ architecture.
Figure 1B:
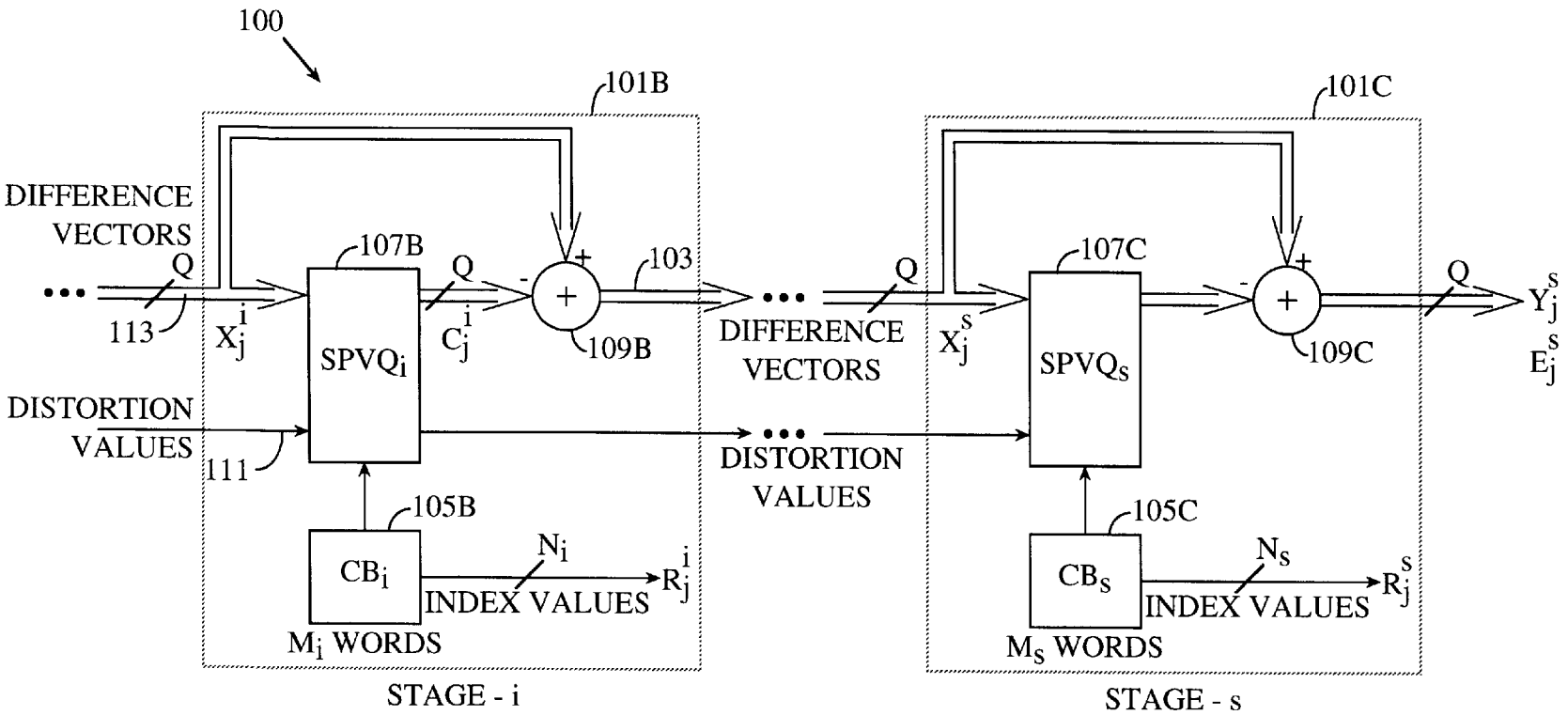
FIG. 1*b* illustrates the subsequent stages of the MPSMS-VQ architecture.
Figure 1C:
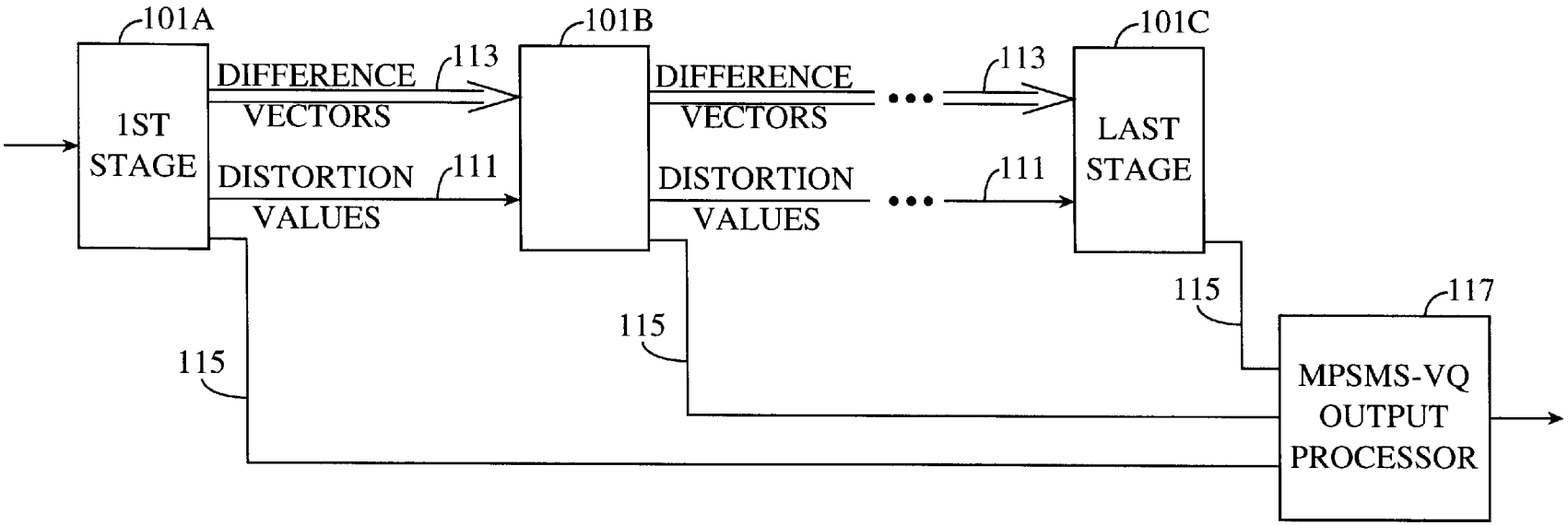
FIG. 1*c* illustrates the stages of the MPSMSVQ architecture.

While the method and apparatus disclosed herein is described with reference to particular illustrative embodiments related to particular applications, it should be understood that the claimed invention is not limited to such embodiments. Those having ordinary skill in the art and access to the teachings provided herein will recognize additional modifications, applications, and embodiments within the scope of the claimed invention and additional fields in which the present invention would be of significant utility. MPSMS-VQ Architecture: FIGS. 1*a*, 1*b*, and 1*c* depict a multi-path, split, multi-stage vector quantizer (MPSMS-VQ) architecture which essentially is formed by S stages 101. FIG. 1*a* illustrates the input stage 101*a* of the MPSMS-VQ architecture. FIG. 1*b* illustrates the subsequent stages 101. The input stage 101 of the multi-stage structure 100 receives one vector. However, unlike a traditional multi-stage vector quantizer (MSVQ), each stage 101 of this multi-stage structure 100 is connected to a next stage 101 by multiple paths 103. The number of paths is denoted as $Q^i$ for the $i^{th}$ stage 101. Therefore, each stage 101, with the exception of the input stage 101, receives a number of vector inputs equal to $Q^i$. Each input vector comprises $L^i$ words. Accordingly, the number of words in the input vector to the third stage is denoted as $L^3$. It should be noted that the superscript i is used throughout this disclosure to denote the particular stage with which a parameter is associated.

Figure 2A:
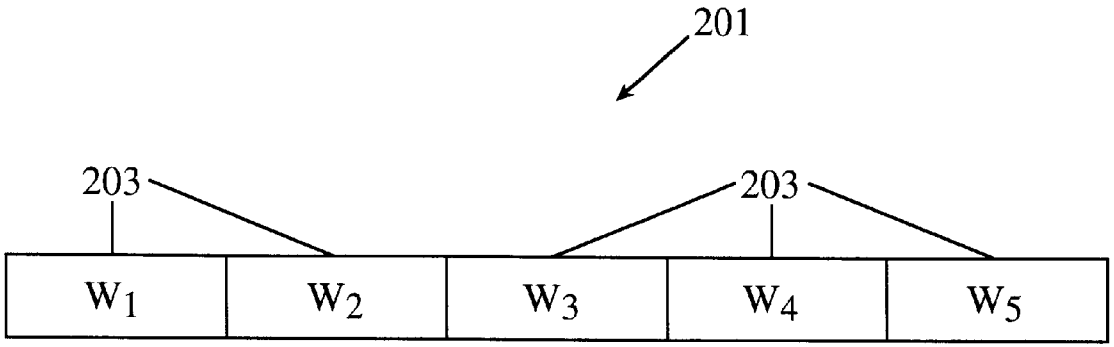
FIG. 2*a* illustrates an example of a vector 101 of length L=5.

Each word within the vector represents a value, such as a line spectral pair (LSP) value in the case of a MPSMS-VQ designed to quantize LSP vectors. In the case in which the input vector represents LSPs, an input device, such as a microphone receives audible speech signals and converts these into electrical signals. The electrical signals are then digitized and coupled to a processor that generates the LSP vectors in known fashion. FIG. 2*a* illustrates an example of a vector 201 of length L=5. It should be noted that the particular values that are represented by the word s ($W_1, W_2, \ldots W_5$) 203 which comprise the vector 201 are dependent upon the type of vector to be quantized. For example, an LSP vector would comprise words 203 that are each LSP values. Accordingly, the words 203 would typically represent an angular value between 0 and Pi, or a value in the range of 0 to sample frequency divided by 2.

Each stage 101 includes: a codebook 105 ($CB^i$); a processor 107; and a subtractor 109. The processor 107 may be a programmable device, such as a computer, microcomputer, mini-computer, personal-computer, general purpose microprocessor, a digital signal processor (DSP), a dedicated special purpose microprocessor, or software module which is executed on such a programmable device. Alternatively, the processor may be implemented in discrete hardware or an application specific integrated circuit (ASIC). The codebook 105 may be a lookup table in a memory device that can be accessed by, or is integrated in, the processor 107. Alternatively, the codebook 105 could be hardwired into the stage 101. Each stage is described as having a different processor. However, it may be desirable to have the processors 107 co-located within a physical processor unit, such that the functions that are described as being distributed among different processors are all performed by a single processor unit. That is, there may be only one physical processor that performs the functions of some or all of the processors in all of the stages of the MPSMS-VQ. Similarly, the codebooks for all of the stages may be stored in one memory device that is shared by each of the stages. Nonetheless, for the sake of clarity, the present method and apparatus is described as having one processor and one codebook associated with each stage.

Figure 2B:
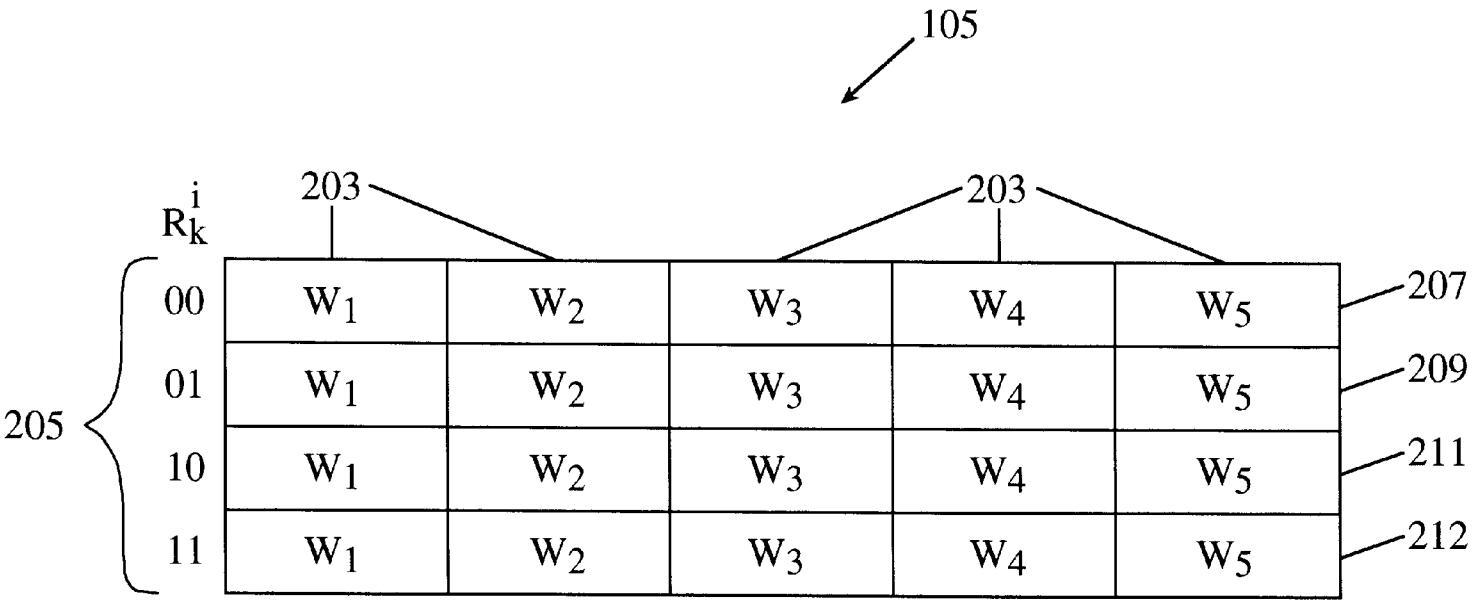
FIG. 2*b* is an illustration of a codebook for the in stage.

FIG. 2*b* is an illustration of a codebook 105 for the $i^{th}$ stage. As shown, vectors for the $i^{th}$ stage have a length of $L^i$.

The length of the stage in the example of FIG. 2*b* is equal to 5. The number of bits used by the $i^{th}$ stage is equal to 2 for the example shown in FIG. 2*b*. The in stage codebook 105 contains a plurality of codevectors 207, 209, 211, 212. Each of the codevectors 207, 209, 211, 212 in the codebook 105 is selected to be in the codebook because that particular codevector is expected to be similar to an input vector to be received by the $i^{th}$ stage. That is, the values that are contained in the words 203 that make up an input vector will be similar to the values of words of a particular one of the codevectors. An index value ($R^i_k$) 205 is assigned to a corresponding codevector 207, 209, 211, 212 in the codebook 105 such that each codevector 207, 209, 211, 212 is represented by the corresponding index value 205. Accordingly, codevectors $C^i_k$ within the codebook 105 (where i indicates the associated stage and k indicates the particular codevector from among the plurality of codevectors stored in the codebook 105 of the $i^{th}$ stage 101) can be represented by a relatively short notation. For example, $R^i_k$ 205 is preferably a binary number having $n^i$ bits ($n^i$ is equal to two in the case of the example shown in FIG. 2*b*). The output from each stage 101 is a predetermined number "Q" of index values, each of the Q index values requiring only $n^i$ bits. In the example provided in FIG. 2*b*, there are only four codevectors 207, 209, 211, 212. However, a typical codebook 105 would have many more than four such codevectors. It should be understood that the value of Q is preferably relatively small with respect to the number of codevectors in the codebook 105.

Each codevector in the $i^{th}$ stage codebook 105 preferably comprises the same number of words 203 as the input codevector 201 to the $i^{th}$ stage. Furthermore, the number of codevectors 201 in the codebook 105 must be less than or equal to (and is typically equal to) 2 raised to the $n^i$ power, since $n^i$ is the number of bits used to express the index value $R^i_k$. That is, only 2 to the $n^i$ power codevectors can be assigned unique index values.

Figure 3:
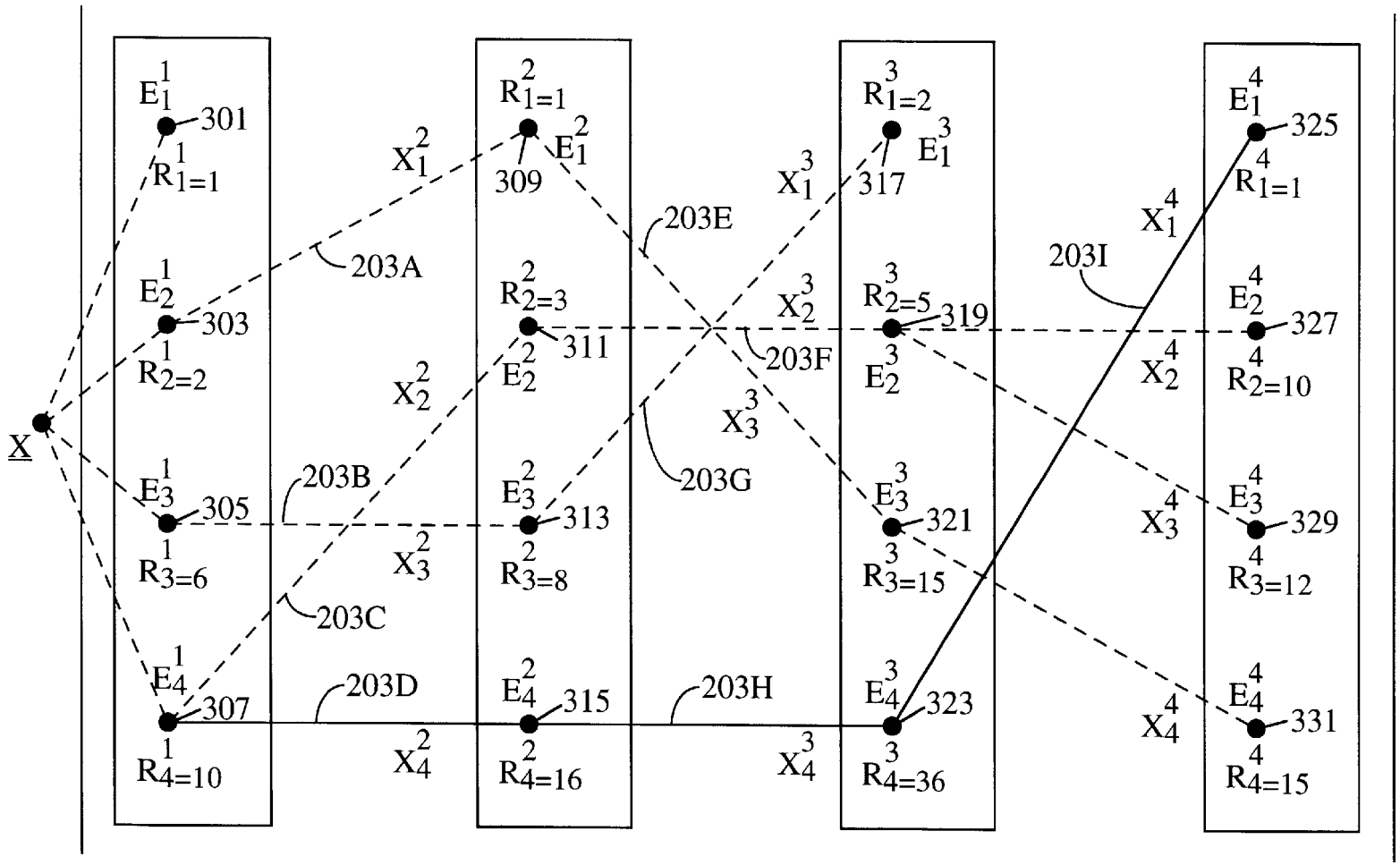
FIG. 3 is an illustration of the manner in which the output from one stage is coupled to the input to the next stage.

FIG. 3 is an illustration of the manner in which the output from one stage 101 is coupled to the input to the next stage 101. It should be noted that the input stage 101*a* receives only one input vector $\underline{X}$. The input vector is compared with each of the codevectors in the codebook associated with the input stage 101 (i.e., the "input stage codebook") to select the Q best codevectors, from among all of the codevectors in the input stage codebook. In one embodiment of the disclosed MPSMS-VQ, codevectors that result in the least distortion with respect to the input vector are considered to be the "best". Other criteria may be used to select particular codevectors, such as a simple determination as to the difference between the input and the codevector. One way to measure the distortion value of a codevector with respect to an input vector is to subtract each of the words 203 of the input vector from a corresponding one of the words of the codevector. Accordingly, the first word in the input vector is subtracted from the first word in the codevector, the second word in the input vector is subtracted from the second word in the codevector, etc., for each of the words 203 (see FIG. 2*a*) of the two vectors. Each of these differences is squared. The squares of the differences are each multiplied by a weighting factor that may have a distinct value for each of the differences based upon their relative location within the input vector and the codevector. The products associated with each pair of words are then summed.

This process is expressed by the following mathematical formula:

$$e_{j,k} = \sum_{m=1}^{L} W[m](Xi, j[m] - Ci, k[m])\text{^}2$$

W[m] is the weighting factor associated with the $m^{th}$ word;

Xi, j[m] is the $m^{th}$ word of the input vector to the $i^{th}$ stage; and

Ci, k[m] is the $m^{th}$ word of the selected codevector in the ith stage.

This process results in each of the codevectors output from the input stage 101*a* being associated with a distortion value with respect to the input vector. The best codevectors (i.e., those which have the lowest distortion with respect to the input vector) are selected. The selected codevectors are coupled to the subtractor 109. In addition, the input vector is coupled to the subtractor 109. The output from the subtractor 109 is the difference between the input vector and each codevector. Accordingly, a number of "difference vectors" are output from the subtractor 109. The number of outputs is equal to the number of codevectors input to the subtractor 109.

As shown in FIG. 1*a*, the total output from the input stage 101*a* is the combination of the distortion values that are output on line 111, the difference vectors output from the subtractor 109 on line 113, and the index values output on line 115. FIG. 3 represents the fact that in the input stage a first distortion value, $E^1_1$ is lowest among all of the distortion values that were calculated. This is represented by the fact that the distortion value $E^1_1$ is physically located above of the other three distortion values in the figure. This distortion value is associated with an index value $R^1_1$=1 in FIG. 3 indicating that the lowest distortion value resulted from the codevector that is associated in the input stage codebook 105*a* with an index value of 1. Likewise, a distortion value $E^1_2$ is the second lowest distortion value and is associated with the index value $R^1_2$=2. The distortion value $E^1_3$ is the third lowest distortion value and is associated with the index value $R^1_3$=6. The distortion value $E^1_4$ is the fourth lowest distortion value and is associated with the index value $R^1_4$=10.

The difference vectors that are output from the input stage 101*a* (shown in FIGS. 1*a* and 1*c*) on line 113 are input into the second stage 101*b* (shown in FIG. 1*b*). In addition, the distortion values that are output from the input stage 101*a* on line 111 are coupled to the second stage 101*b*. Each difference vector is associated with the distortion value generated for the codevector that was used to generate the difference vector. The index values are coupled to an MPSMS-VQ output processor 117 or alternatively, to the last stage 101*c* of the MPSMS-VQ 100.

Each of the difference vectors is compared to the codevectors stored in the codebook 105*b* associated with the second stage 101*b* and a distortion value is calculated for each codevector with respect to each difference vector in the manner described above with respect to the input stage. In addition, the distortion from the input stage is added to the distortion from the second stage to generate an "overall" distortion.

It should be noted that there are Q such difference vectors output from the input stage 101*a* to the second stage 101*b*. Therefore, if there are M codevectors in the second stage codebook 105*b* and the value of Q for the input stage is equal to 4, then the second stage processor 107*b* must calculate 4×M distortion values. Base upon these 4×M distortion values, the second stage processor 107*b* selects the Q best codevectors from the second stage codebook 105*b* (i.e., the 4 codevectors that result in the least overall distortion, assuming that the value of Q for the second stage is also equal to 4). As shown in FIG. 1*b*, the second stage generates and outputs a number of difference vectors (the number being equal to the Q of the second stage) similar to the difference vectors generated by the input stage 101*a*. However, in the case of the second stage 101*b*, the difference vectors are the difference between the difference vectors output on line 113 from the input stage and the codevectors output from the second stage processor 107*b*. Also, the second stage 101*b* outputs the Q best overall distortion values and the Q index values associated with the codevectors that are selected by the second stage processor 107*b*. As is the case with the input stage 101*a*, the overall distortion values output from the second stage are coupled to the third stage and the index values that are coupled to either the output processor 117 or the last stage 101*c*.

In the example shown in FIG. 3, the overall distortion values that were calculated in the second stage based upon the difference vector associated with the distortion value $E^1_1$, were not among the lowest four distortion values calculated. That is, at least four other overall distortion values generated with respect to other difference vectors input to the second stage were lower then the lowest overall distortion value generated with respect to the difference vector associated with the distortion value $E^1_1$. This is represented by the fact that the lines 203*a*, 203*b*, 203*c*, 203*d* connect each of the points 309, 311, 313, 315 only with the points 303, 305, and 307 and not with the point 301. In addition, FIG. 3 represents that the best distortion value $E^2_1$ calculated in the second stage 101*b* results from selecting the codevector from the second stage codebook 105*b* that is associated with the index value $R^2_1$=1 and generating the distortion value for that codevector with respect to the difference vector that was generated from the codevector $R^1_2$=2 in the input stage.

This process of coupling the difference vectors from the previous stage to the next stage together with the distortion values of the present stage in order to generate new overall distortion values and then selecting a new set of codevectors from which new difference vectors are generated continues in each of the subsequent stages 101*c*. In the example shown in FIG. 3 in which there are four stages, the best overall distortion Ehu $\mathbf{4}_1$ at the output of the last stage 101*c* is shown to come from the difference vector that resulted in the fourth least overall distortion $E^3_4$ in the third stage. This is represented by the line 203*i* that connects the point 323 to the point 325. That is, the overall distortion that results from the combination of the codevectors associated with the index values $R^1_4$, $R^2_4$, $R^3_4$, and $R^4_1$ is lower than the overall distortion that results from the other three "paths" which resulted in the three others of the four best overall distortions $E^4_2$, $E^4_3$, and $E^4_4$. The path taken to the second best overall distortion output from the last stage 101*c* includes $R^1_4$, $R^2_2$, $R^3_2$ and $R^4_2$. The path taken to the third best overall distortion output from the last stage 101c includes $R^1_4$, $R^2_2$, $R^3_2$ and $R^4_3$. The path taken to the fourth best overall distortion output from the last stage 101*c* includes $R^1_2$, $R^2_1$, $R^3_3$ and $R^4_4$ . Accordingly, the "path" is defined as the chain of codevectors (represented by index values) which result in an overall distortion.

An interesting point to note here is that if we followed the "greedy" method of MSVQ, then at the input stage, we would have chosen the codevector, denoted by $R^1_1$, that resulted in the best distortion value. However, the best overall distortion results from the path that starts with the codevector that results in the fourth best distortion value at the input stage. Accordingly, a conventional MSVQ would obtain a much poorer solution. Thus, the multipath network of the MPSMS-VQ architecture 100 overcomes the deficiency of the prior art MSVQ architecture.

Figure 4:
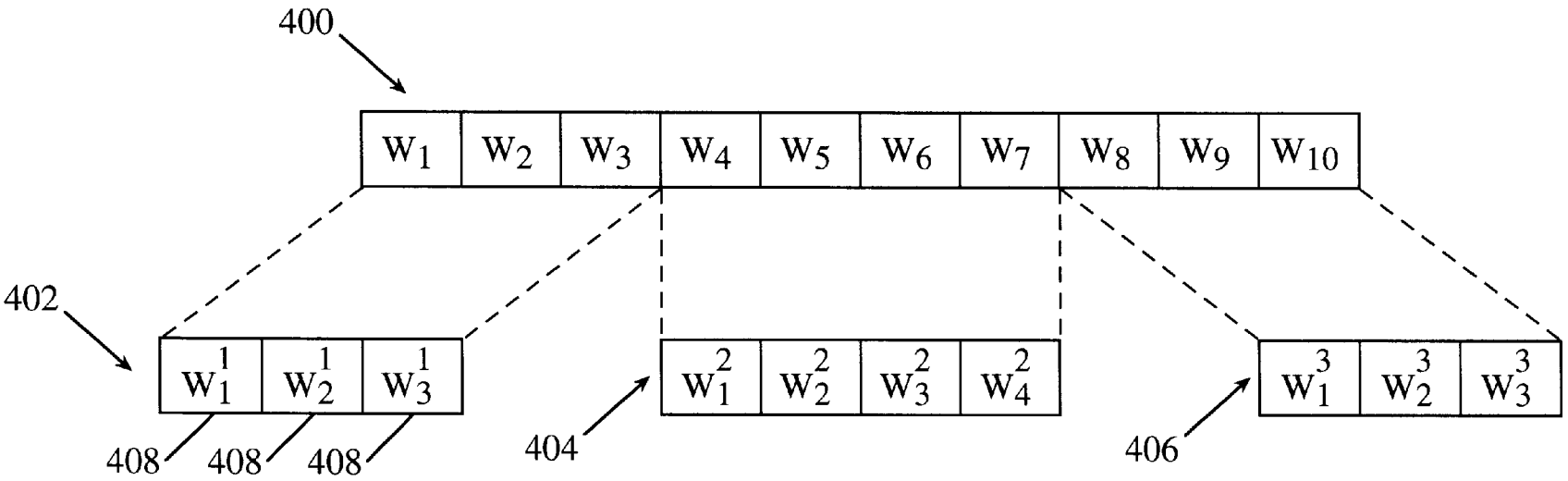
FIG. 4 is an illustration of an input vector that has a length of 10 words and which has been split into three input "sub-vectors" having lengths of three words, four words, and three words, respectively.

The architecture shown in FIGS. 1–3 illustrates the case in which the input vectors to each stage are not "split". However, in accordance with one embodiment of the disclosed method and apparatus, each stage 101 is a split-VQ with $P_i$, splits of length $L^i_1$, where 1=1, 2, 3, . . . , $P_i$. FIG. 4 is an illustration of an input vector 400 that has a length of 10 words and which has been split into three input "sub-vectors" 402, 404, 406 having lengths of three words, four words, and three words, respectively. The number of bits $N_i$ that are available to represent the codevectors for each stage are divided so that a portion of these bits is made available to be used as index values which are associated with the "sub-codevectors" stored in each "sub-codebook".

Figure 5:
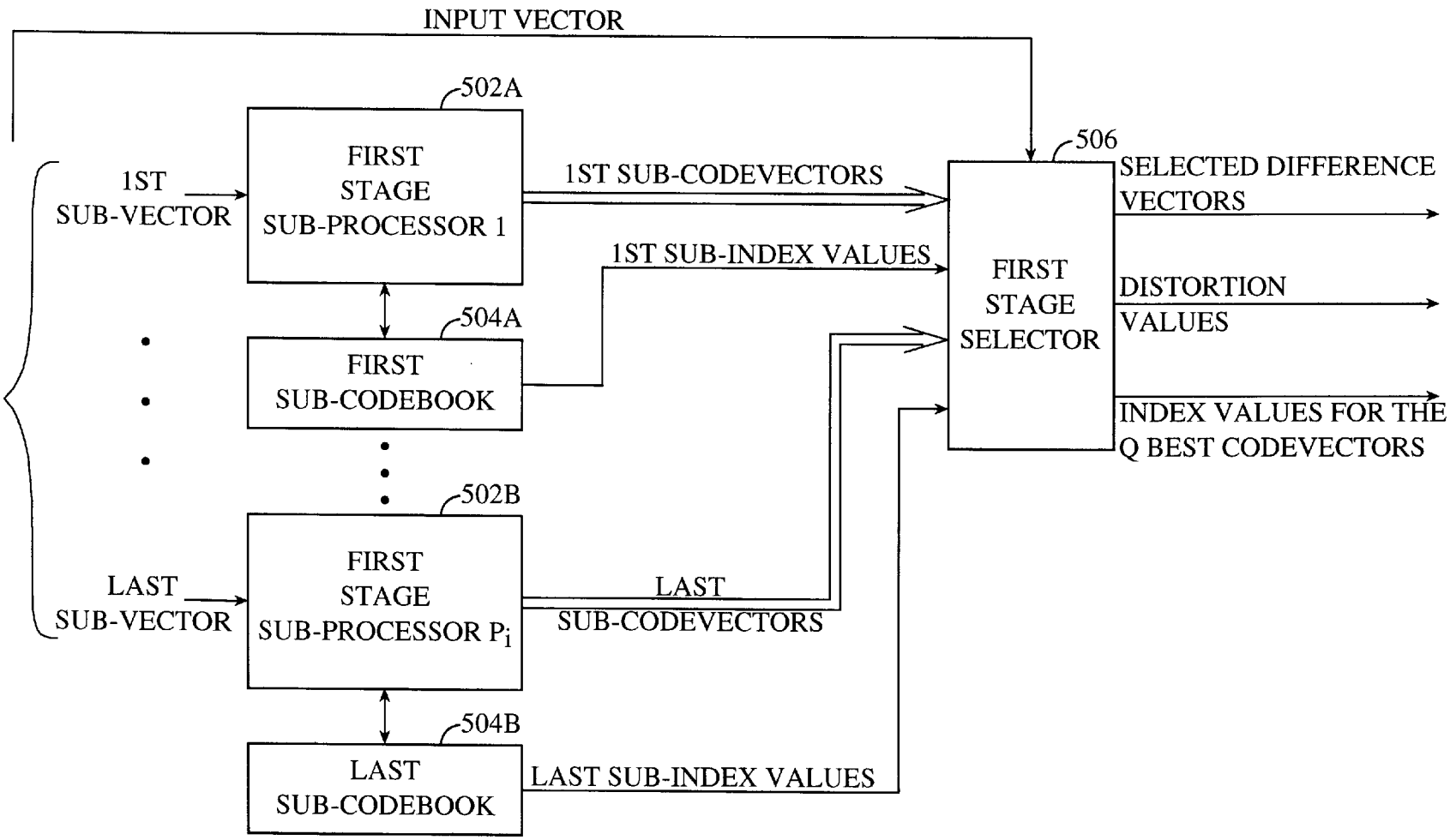
FIG. 5 is an illustration of the architecture of the input stage of the disclosed method and apparatus that performs a split vector quantization.

FIG. 5 is an illustration of the architecture of the input stage 500 of the disclosed method and apparatus that performs a split vector quantization. In accordance with one embodiment of the disclosed method and apparatus, the number of processors 502 and the number of sub-codebooks 504 are equal to the number of sub-vectors into which the input vector 400 has been split. However, it should be understood that a single processor 502 may be used to perform the processing for each of the input sub-vectors 402, 404, 406. Alternatively, two or more discrete processors may be used in each of the stages. Nonetheless, for ease of understanding, the functions that are performed which respect to each sub-vector are referred to as being performed in different "sub-processors". Each sub-processor 502 performs essentially the same function. That is, each sub-processor 502 receives the input sub-vector and selects a predetermined number of the best sub-codevectors in the associated sub-codebook 504 with respect to the input sub-vector. The best sub-codevectors are selected based upon the amount of distortion resulting from each in essentially the same way as was described above with respect to the method and apparatus in which the input vector is not split. That is, each of the words 408 which comprise the input sub-vector 402 is subtracted from a corresponding one of the words which comprise the sub-codevector. Accordingly, the first word in the input sub-vector is subtracted from the first word in the sub-codevector, the second word in the input sub-vector is subtracted from the second word in the sub-codevector, etc., for each of the words 408 of the two sub-vectors. Each of these differences is squared. The squares of the differences are each multiplied by a weighting factor that may have a distinct value for each of the differences based upon their relative location within the input vector and the codevector. The products associated with each pair of words are then summed.

Each of the selected sub-codevectors is associated with a sub-index value. The selected sub-index values from each sub-codebook 504 are output to a selector 506. In addition, the selected sub-codevectors are coupled from either the sub-processors 502 or the codebooks 504 directly to the selector 506.

The entire input vector (i.e., the concatenation of each of the input sub-vectors) is also coupled to the selector 506. The selector 506 then selects a predetermined number of combinations of the sub-codevectors such that the selected combinations will have the least distortion with respect to the input vector. In the example shown in FIG. 4 in which the input vector 400 is split into three sub-vectors 402, 404, 406, the first sub-processor 502*a* selects a predetermined number of sub-codevectors from the first sub-codebook 504*a* which have the least amount of distortion with respect to the input sub-vector 402. Assuming that the predetermined number is 4, then the four best sub-codevectors are selected from the sub-codebook 504. A second sub-processor (not shown) then selects a predetermined number of the best sub-codevectors, which may or may not be equal to 4. Similarly, the last sub-processor 502*b* selects a predetermined number of best sub-codevectors from the last sub-codebook 504*b*. The number of best sub-codevectors selected by the last sub-processor 502*b* may be distinct from either 4 or the number of codevectors selected by the second sub-processor. For the present example, assume that all three sub-processors 502 select the four best sub-codevectors. The selector 506 then takes one sub-codevector selected by the first sub-processor 502*a*, one sub-codevector selected by the second sub-processor, and one sub-codevector selected by the last sub-processor 502*b* and concatenates these three sub-codevectors to form a codevector having the same length as the input vector 400. There will be 4×4×4 unique combinations in which one sub-codevector is selected by each sub-processor 502. A predetermined number, Q, of the best of all the possible combinations of codevectors in which one sub-codevector is taken from each subprocessor 502 are then used to generate Q difference vectors to be output from the input stage. In addition, the output from the input stage will include an index vector associated with each difference vector. These index vectors will provide the index values for each of the sub-codevectors that were used to produce the codevector from which the difference vector was generated. Also, a distortion value for each of the codevectors is calculated by the selector 506 and output to the next stage. Accordingly, except for the fact that there is more than one index value associated with each difference vector (and thus an index vector is defined), the output from such a split vector stage is essentially the same as the output from a stage in which the input vector is not split. The output from each stage is coupled to the next stage and the process continues as described above until the last stage.

The number of sub-codevectors in each sub-codebook is equal to 2 raised to the power of $n^i_1$ where $n^i_1$ is the number of bits available to represent the index values associated with the $1^{th}$ sub-codebook in the $i^{th}$ stage, where 1=1, 2, 3, . . . , $P_i$. The number of words required for each sub-codebook is $L^i_1$ times the number of sub-codevectors, since each sub-codevector is of a length equal to the length of the subvectors which the sub-codevector is intended to represent. Therefore, the total memory requirement for each stage is equal to the sum of the number of words required in each of the sub-codebooks in the stage. Furthermore, the total memory requirement for the entire MPSMS-VQ architecture is equal to the sum of all of the words required in all of the codebooks in all of the stages.

The disclosed MPSMS-VQ offers a flexible architecture having parameters which can be customized to fit the requirement of the given no-of-bits and memory-word constraint of any VQ application. For example, the following parameters can be adjusted to customize the architecture: (1) the number of paths between any two stages; (2) the number of stages; (3) the number of bits that can be assigned to represent the index values; (4) the number of words of memory required to store the codebook; (5) the number of splits of the input vector for each stage (note that the number of splits for each stage need not be identical); and (6) number of bits assigned to each split. It should be noted that there is a relationship between the number of bits that can be assigned to represent the index values, the memory requirement, and the length and number of splits. The MPSMS-VQ architecture, combines the low-memory advantage and flexibility of conventional MSVQ, the high-resolution advantage of Split-VQ and adds more flexibility and performance by using a trellis-coded multipath network.

The performance advantage and flexibility of this invention over these conventional structured VQ schemes, as seen in actual implementations, stem from the fact that MPSMS-VQ is a more flexible and powerful scheme as shown here.

Figure 6:
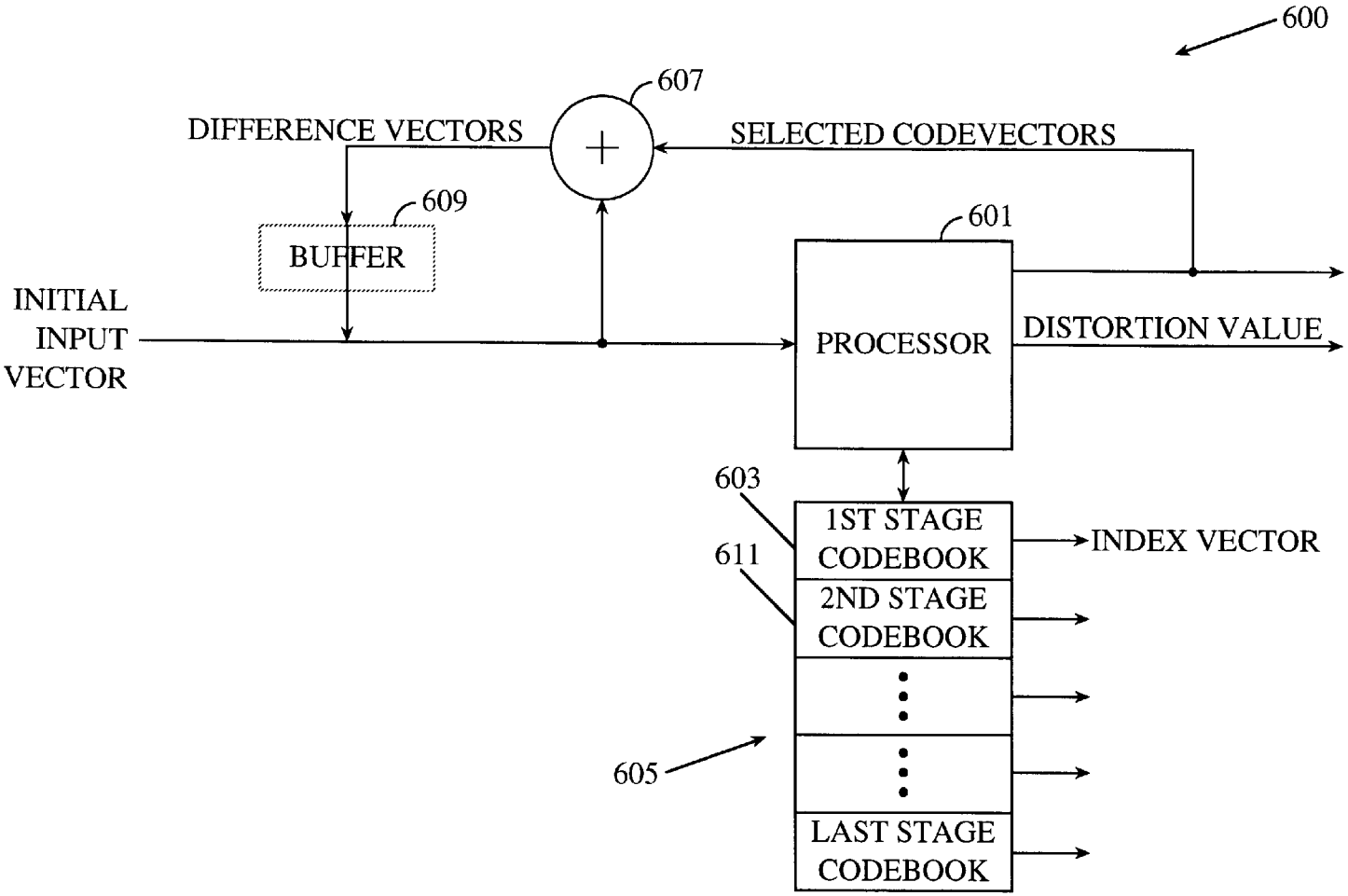
FIG. 6 is an illustration of one way in which the disclosed apparatus can be implemented.

FIG. 6 is an illustration of one way in which the disclosed apparatus can be implemented. As shown, one processor 601 is provided which performs the processing for each of the multiple stages of the MPSMS-VQ 600. Initially, an input vector as described above is coupled to the processor 601. The input vector is compared by the processor 601 with each of the codevectors associated with a first stage 603 codebook stored within in a codebook device 605. A number of the best codevectors are selected from the codebook, the number being determined by a parameter of the system. For each selected codevector, an index associated with the codevector is output (either directly from the codebook device 605 or from the processor 601) in the form of an index vector (i.e., a string of index values, each associated with one of the selected codevectors). The codevector is then coupled to a subtracting device 607. The input vector is also coupled to the subtracting device 607. The codevector is subtracted from the input vector to generate a difference vector which is then coupled back to the processor 601 for the second stage operation. In one case, a buffer 609 may be used to hold the difference vector that is output from the subtracting device 607 until the first stage operation is complete. Accordingly, one difference vector is generated for each selected codevector. In addition, the processor 601 outputs a distortion value associated with each codevector that is selected. Alternatively, the distortion value is saved within the processor 601 to be used in determining the path through from the best final distortion value to the input vector, as was described above.

The difference vectors are then input into the processor 601 and compared with the codevectors in the second stage codebook 611 within the codebook device 605. A number of the best codevectors are then selected. The selected codevectors are coupled to the subtracting device 607 which generates difference vectors for each of the codevectors with respect to the difference vectors that were input from the first stage process. A total distortion value is generated for each of the new difference vectors (i.e., the "second stage difference vectors") with respect to the first stage difference vectors. The total distortion value is used to select the codevectors from the second stage codebook 611. An index vector is output which indicates the index values that are associated with the selected codevectors of the second stage codebook 611. This processor continues in the same way until each stage process has been completed. At the end, the path to the codevector which is selected for having the least total distortion is noted to provide an index vector which maps the codevectors that should be used to represent the input vector.

It should be clear that this process is essentially identical to the process described above. However, there is only one processor used to perform the process. It should be noted that the same architecture can be used to perform the MPSMS-VQ process with split input and difference vectors at the input to each stage.

One way in which selecting the best codevectors from among all of the codevectors in the codebook can be done is using a bubble-sort-encoding mechanism as described below:

Step 1. Start by filling up a "Q-best-array" with entries. The Q-best-array is a table having a predetermined number of entries in which each entry includes the following three components: (1) a difference vector, $Y^i_{j,k}$, (2) a value of distortion, $D^i_{j,k}$, and (3) an index value, $R^i_k$, which represents the codevector that results in the associated distortion value $D^i_{j,k}$, where j is the particular input difference vector and k refers to the position of the codevectors within the codebook. The predetermined number should be equal to the value of Q. Initial values for the following procedure are set such that j=1 and k=1, 2, 3, . . . Q, for the Q number of entries into the Q-best-array. So, for example, if Q is equal to four, the Q-best-array should have four difference vectors and their associated index values and distortion values.

Initially, the order of the entries in the Q-best-array is set such that the first entry in the array has the lowest distortion, the second element in the array has the second lowest distortion, the third element in the array has the third lowest distortion, etc.

Step 2. If (k<Mi) (i.e., the last codevector in the codebook has not been checked), then k=k+1 (i.e., check the next codevector), else {k=1; j=j+1} (i.e., start from the beginning of the codebook with the next input difference vector).

Step 3. If (j>Q) (i.e., the last input difference vector has been checked), then go to step 6, otherwise continue;

Step 4. Compute the distortion for the current codevector and input difference vector $D^i_{j,k}$ Step 5. If ($D^i_{j,k}$>lastD) (i.e., the distortion of the current codevector is less than the last element in the array), then go to step 2, Otherwise, Step 6. Update best-array by replacing lastD with $D^i_{j,k}$. and resorting the elements in the best-array in order of the distortion values and go to step 2;

Step 7. Stop

At the end, we will have the Q-best paths, with the Q lowest distortions as measured up to the last stage.

The final selection from among the Q selected codevectors in the last stage can be made in at least the following two ways: a) according to WMSE, i.e., select the path which terminates with the lowest overall distortion; or b) select the best out of the Q paths according to a more meaningful, but more complex error measure, such as spectral distortion (SD), i.e., pick the $j^*$-th path, if the spectral distortion of the entire path with respect the input vector to the input stage is less than the spectral distortion of the all other paths with respect to the input vector to the input stage. The set of selected indexes, that are determined by the selected path are transmitted to the MPSMS-VQ decoder using the given N bits.

MPSMS-VQ Decoding Mechanism: When the MPSMS-VQ decoder receives the selected best path index $\{R^1_{k1}\ R^2_{k2}\ R^3_{k3} \ldots R^s_{ks}\}^*$, it can create the quantized value of X, by summing the contributions from the codebooks of different stages as described in the preceding section.

MPSMS-VQ Design Algorithm: Given particular VQ constraints (i.e., given the constraints in terms of number of bits to be used to express the output of the quantizer, Nc, number of memory words available, Mc, and some limit on the computational complexity) an optimal implementation of the MPSMS-VQ can be attained by a judicious selection of its parameter set. The parameter set preferably includes: (1) the number of paths between any two stages; (2) the number of stages; (3) the number of bits that can be assigned to represent the index values; (4) the number of words of memory required to store the codebook; and (5) the number of splits of the input vector for each stage (note that the number of splits for each stage need not be identical). It should be noted that there is a relationship between the number of bits that can be assigned to represent the index values, the memory requirement, and the length and number of splits. Some general guidelines which should be noted with respect to the disclosed method and apparatus are:

An increase in the number of stages, reduces complexity and memory usage;

An increase in the number of paths between stages increases the performance and the robustness of the performance across a broad input vector statistics;

An increase in the number of paths between stages also increases the complexity;

Adding more splits in individual stages reduces memory usage and complexity. However, doing so degrades the performance of that individual stage. Nonetheless, the impact such a degradation on the overall performance may not be significant due to the robustness of the architecture;

Adding the most possible bits to the $1^{st}$ stage (as much as can be allowed by the memory and complexity constraints), improves performance significantly, since it markedly reduces the variance of the vectors that are input to the subsequent stages; and A relatively large number of bits in the input stage can be practically implemented by adding splits in the input stage.

An example implementation of a 28 bit MPSMS-VQ is implemented in a DSP implementation with the following parameters:

VQ constraints: L=10; N=28 bits; M<=6Kwords; complexity as low as possible.

Chosen parameters: S=3;

N1=14 bits; N2=7 bits; N3=7 bits;

P1=2; L11=5; N11=7bits; L12=5; N12=7 bits; P2=1; P3=1;

Q=8;

Memory used=5120 words<6000 words;

Performance: significantly better than

Split-VQ(4 splits of dimension 2 each; 7-bit/split) and

MSVQ (4 stages; 7 bits/stage)

MPSMS-VQ CodeBook Design: Once the MPSMS-VQ design parameters are determined (based on established VQ constraints), the next task is to design the codebooks for each stage.

The codebook design has two steps: a) initial codebook design, and b) joint-optimization of stages. A training set of $N_T$ vectors that are of a predetermined length L are initially used in which TR=$\{X_k\}$ represents the statistical distribution of the input LSP vectors. In addition, a corresponding set of $N_T$ weight vectors W=$\{W_k\}$ are defined. Accordingly, the initial codebooks of each stage of MPSMS-VQ are designed as follows: First, the number of paths is set to one. The training set $TR_1$ of the input stage is set to TR, and the codebook of the input stage $CB_1=\{C^1_k\}$, k=1,2, . . . $N_1$, is designed using $TR_1$ and W using the conventional LBG algorithm for codebook design (as described in detail in *Vector Quantization and Signal Compression*, A. Gersho, Kluwer, and R. M. Gray, academic publishers, 1992. Then, for each training set vector, $X_k$, the corresponding difference vector $Y^1_k$ is obtained, collection of these $Y^1_k$ makes the training set for the next stage $TR_2=\{Y^1_k\}$.

The $2^{nd}$ stage codebook, $CB_2=\{C^2_k\}$, is then designed using $TR_2$ and W, and then the training set of the third stage, $TR_3=\{Y^2_k\}$, is produced. This process is continued until all the codebooks, $CB_i$, for all the S stages, are designed. These set of codebooks, $\{CB_1, CB_2 \ldots CB_s\}$, constitutes the initial codebooks of the MPSMS-VQ and next a joint-optimization is performed to design the final codebooks.

Joint Optimization of MPSMS-VQ codebooks: The number of paths is set to its actual value Q. Let, $\{CB_1, CB_2 \ldots CB_s\}^i$ be the set of codebooks at the i-th iteration of the joint-optimization, i.e., $\{CB_1, CB_2 \ldots CB_s\}^0$ is the set of initial codebooks ($0^{th}$ iteration). Given the set of codebooks, $\{CB_1, CB_2 \ldots CB_s\}^i$, for an input vector $X_k$ and weight vector $W_k$, let Zbe the most optimal quantized vector in terms of WMSE as found by the MPSMS-VQ encoding mechanism. Then, the total training error, at the i-th iteration, $E^i_T$, is defined as $$e_{j,k} = \sum_{m=1}^{L} W[m](Xi, j[m] - Ci, k[m])\text{^}2$$

W[m] is the weighting factor associated with the mth word;

Xi,j[m] is the mth word of the input vector to the ith iteration; and

Ci,k[m] is the mth word of the selected codevector in the ith iteration.

The joint optimization algorithm of MPSMS-VQ codetooks is summarize below:

Step 1. Start with the initial set of codebooks, $\{CB_1, CB_2 \ldots CB_s\}^0$. Set the iteration index i=0. Compute $E^0_T$, the total distortion with these set of codebooks.

Step 2. Set iteration index i=i+1. Now, keep all other codebooks, $CB_j$, constant (i.e. do not change them), and re-design codebook $CB_i$. After the training of $CB_i$ is done, recompute the new total training distortion, $E^i_T$.

Step 3. If $((E^i_T-E^{i-1}_T)>D_{training})$ then go to step2, otherwise go to step 4. $D_{training}$ is some predetermined threshold, a small number. In other words, continue the iteration as long as there is improvement in performance, otherwise stop.

Step 4. Stop. Save the final set of codebooks. The design is completed. Re-design of the selected codebook $CB_i$: The main algorithm for the re-design of the codebook is outlined here, for details of any VQ codebook design mechanism (the LBG algorithm) as described in detail in *Vector Quantization and Signal Compression*, A. Gersho, Kluwer, and R. M. Gray, academic publishers, 1992.

We want to redesign the Ni codevectors $\{C^i_k\}$, k=1,2, . . . , Ni, of the i-th stage codebook $CB_i$, while we are keeping all other codebooks frozen. Now like any VQ training algorithm, the redesign of the the Ni codevectors of $CB_i$ under consideration here, involves a) starting with the initial codebook $\{CBi\}^0$, and b) repeated iterations of the following set of two steps: b1) partitioning all input vectors into Ni partitions around the current codevectors, and b2) replace the current codevectors with the centroids of the partitions. The algorithm is detailed below:

Step 1. Set iteration step J=0; Set the Jth iteration codebook of stage-I, $\{CB_i\}^j$ to $CB_i=\{C^i_k\}$, ie, $C^{i,j}_k=C^i_k$, k=1,2, . . . , Ni;

Step 2. Given the set of codebooks $\{CB_1, CB_2 \ldots CB^J_i \ldots CB_s\}^i$, compute the total training error $E^i_T$. Set $E^{iJ}_T=E^i_T$. Now, for an input vector $X_k$ and weight vector $W_k$, of the training set, let $Z_k$ be the most optimal quantized vector as found by MPSMSVQ and let $\{R^1_k R^2_k \ldots R^i_k \ldots R^S_k\}$ denote the corresponding set of indexes for this quantized vector $Z_k$. Let denote the corresponding input at stage-i (for which we are re-designing the codebook). Thus for the training set $\{X_k\}$, k=1,2, . . . , $N_T$, we have now a corresponding set of ith stage inputs$\{X^i_k\}$ and ith stage indexes $\{R^i_k\}$.

Step 3. Form the Ni new partitions as follows: For each input vector to stage-I, $\{X^i_k\}$, k=1,2, . . . , $N_T$, place it and the corresponding weight vector $W_k$ in the m-th partition if its corresponding index $R^i_k$ equal m.

Step 4. Replace each old codevector, $C^{i,J}_m$, m=1,2, . . . , Ni, by the centroid of the m-th partition Step 5. Now we have a new codebook for the ith stage, $CB^{J+1}_i=\{C^{i,J+1}_k\}$. Compute the total training error $E^{i,j+1}_T$ with this new set of codebooks $\{CB_1, CB_2 \ldots CB^{J+1}_i \ldots CB_S\}^i$. If $((E^{i,J+1}_T-E^{i,J}_T)>D_{joint\text{-}training})$ then set J=J+1 and go to step 3, otherwise go to step 6 (stop) ($D_{joint\text{-}training}$ is some predetermined threshold, a small number). In other words, continue the iteration as long as there is improvement in performance, otherwise stop.

Step 4. Stop. Save the final codebook and call it $CB_i$. The re-design of the codebook of stage-i is completed.

It can be seen from the above that the disclosed method and apparatus offers greater flexibility and superior performance. Instead of finding a "local" best solution, a "global" or overall best solution is obtained by MPSMS-VQ.

The disclosed method and apparatus has been described with reference to particular embodiments. However, those having ordinary skill in the art will recognize from the present disclosure that additional modifications are possible which would fall within the scope of the invention as recited in the appended claims. Particular values that have been used in the examples provided in this disclosure are not to be considered as limitations or ideal values, but rather are provided only to make the disclosure easier to understand. In addition, it should be understood that the processors and codebooks of each stage of the MPSMS-VQ may be implemented by a single processing device which performs the functions of all the processors and/or codebooks of all the stages. Furthermore, it should be clear that the scope of the present invention is to be determined solely by the expressed limitations and features of the appended claims. The scope of the present invention should not be considered to be limited by the particular limitations and features of the disclosed method and apparatus unless those features or limitations are expressed in the claim at issue.

I claim:

1. An apparatus for quantizing vectors, comprising:

a plurality of split vector quantization codebook stages, each split vector quantization codebook stage having at least two sub-codebooks, there being one sub-codebook for each split of a given split vector quantization codebook stage, wherein a set of best candidate codevectors is selected for each split and from each split vector quantization codebook stage; and a trellis-coded, multipath, backward tracking mechanism for selecting a final codevector from the sets of best candidate codevectors.

2. A method of training codevectors for each sub-codebook of each split vector quantization codebook stage in the apparatus of claim 1, comprising the steps of:

obtaining an initial set of sub-codebooks;

training one sub-codebook while fixing the remaining sub-codebooks of the initial set of sub-codebooks;

comparing an input training vector for the one sub-codebook with the final codevector to derive a distortion measure;

forming a partition for each current sub-codebook entry of the sub-codebook being trained, the partition comprising a set of training data that minimizes the distortion measure for the sub-codebook entry;

updating each partition with a centroid partition; and performing the training, comparing, forming, and updating steps for each sub-codebook to achieve an overall distortion measure.

3. The apparatus of claim 1, further comprising means for training codevectors for each sub-codebook of each split vector quantization codebook stage.

4. The apparatus of claim 3, wherein the means for training comprises:

means for obtaining an initial set of sub-codebooks;

means for training one sub-codebook while fixing the remaining sub-codebooks of the initial set of sub-codebooks;

means for comparing an input training vector for the one sub-codebook with a final codevector to derive a distortion measure;

means for forming a partition for each current sub-codebook entry of the sub-codebook being trained, the partition comprising a set of training data that minimizes the distortion measure for the sub-codebook entry;

means for updating each partition with a centroid partition; and means for performing the training, comparing, forming, and updating steps for each sub-codebook to achieve an overall distortion measure.

5. In a multistage, multipath, split vector quantizer, the quantizer including a plurality of split vector quantization codebook stages, each split vector quantization codebook stage having at least two sub-codebooks, there being one sub-codebook for each split of a given split vector quantization codebook stage, wherein a set of best candidate codevectors is selected for each split and from each split vector quantization codebook stage; and a trellis-coded, multipath, backward tracking mechanism for selecting a final codevector from the sets of best candidate codevectors, a method of training codevectors for each sub-codebook of each split vector quantization codebook stage, the method comprising the steps of:

obtaining an initial set of sub-codebooks, there being at least two sub-codebooks available in each split vector quantization codebook stage;

training one sub-codebook while fixing the remaining sub-codebooks of the initial set of sub-codebooks;

comparing an input training vector for the one sub-codebook with a final codevector to derive a distortion measure;

forming a partition for each current sub-codebook entry of the sub-codebook being trained, the partition comprising a set of training data that minimizes the distortion measure for the sub-codebook entry;

updating each partition with a centroid partition; and performing the training, comparing, forming, and updating steps for each sub-codebook to achieve an overall distortion measure.

* * * * *